United States Patent [19]

Sawada et al.

[11] 4,330,698

[45] May 18, 1982

[54] MICROWAVE MELTER

[75] Inventors: Yoshihisa Sawada; Fumiaki Komatsu, both of Nishinomiya; Kazuo Sanada, Kobe; Yorihisa Sakaki, Akashi, all of Japan

[73] Assignee: Doryokuro Kakunenryo Kaihatsu Jigyodan, Tokyo, Japan

[21] Appl. No.: 141,905

[22] Filed: Apr. 21, 1980

[30] Foreign Application Priority Data

Apr. 21, 1979 [JP] Japan ..... 54-49599

[51] Int. Cl.[3] ..... H05B 6/80

[52] U.S. Cl. ..... 219/10.55 A; 219/10.55 M; 373/10

[58] Field of Search ..... 219/10.55 R, 10.55 A, 219/10.55 F, 10.55 B, 10.55 M; 13/9 ES, 31

[56] References Cited

U.S. PATENT DOCUMENTS 2,586,754 2/1952 Wild .
3,429,359 2/1969 Hollingsworth ..... 219/10.55 R X
3,770,870 11/1973 Kervizic et al. ..... 13/31
3,777,106 12/1973 Nuccel ..... 13/9 ES
4,039,797 8/1977 Olsen .
4,221,680 9/1980 Hardwick ..... 219/10.55 R X

OTHER PUBLICATIONS

Allen, AC, Arcing Microwaves Spark Revolution in Kiln Design, Ceramic Industry Magazine, 3-70.

*Primary Examiner*—Arthur T. Grimley
*Attorney, Agent, or Firm*—Oblon, Fisher, Spivak, McClelland & Maier

[57] ABSTRACT

A microwave melter in which a material charged in a crucible is heated and melted by irradiation of microwaves, the melter including a melting furnace having an upper furnace body fixedly mounted on a support structure and a lower furnace body detachably connectable with the upper furnace body, a waveguide for guiding microwaves from a microwave generator toward the furnace, a crucible received rotatably and in a suspended state in the lower furnace body, and a feed pipe for feeding untreated material to the crucible.

6 Claims, 6 Drawing Figures

MICROWAVE MELTER

BACKGROUND OF THE INVENTION

1. Field of the Invention

This invention relates to a microwave melter.

2. Description of the Prior Art

The method of heating and melting various materials by the induction heating phenomenon which is generated by irradiation of microwaves has a number of advantages over other methods, for example, uniform heating and melting of the material and arbitrary control of the speed of the melting process through the adjustment of the microwave applying power.

The principles of heating by irradiation of microwave can be used in various fields for diversified purposes. For instance, slurries of waste material which are discharged from various industrial processes can be reduced considerably in volume by a drying or melting-/solidifying treatment resorting to the irradiation of microwaves to facilitate handling in subsequent stages. The melting/solidifying treatment for the "volumetric reduction" by irradiation of microwave can also be applied to radioactive waste material which is discharged and collected from an atomic plant for storage in an isolated place for a long time period for the purpose of saving the number of containers and space for storage to contribute to the increase of the storing capacity while reducing the amount of labor which is required in handling the waste material.

Therefore, there has been a strong demand in the art for a microwave melter which is capable of processing various materials safely and efficiently.

SUMMARY OF THE INVENTION

It is therefore an object of the present invention to provide a novel microwave melter which is suitable for industrial applications.

According to the present invention, there is provided a microwave melter of the type in which a material charged in a crucible of a furnace is heated and melted by irradiation of microwaves, the melter including: an upper furnace body fixed on a support structure a lower furnace body detachably connectible with the upper furnace body a waveguide connected to the upper furnace body a tuner mounted on the upper furnace body for tuning the microwaves to be led into the furnace through the waveguide a feed pipe for feeding untreated material into the crucible and a rotatable container mounted in the lower furnace body for rotating the crucible in a suspended state.

The above and other objects, features and advantages of the present invention will become apparent from the following description and the appended claims, taken in conjunction with the accompanying drawings which show by way of example preferred embodiments of the invention.

BRIEF DESCRIPTION OF THE DRAWINGS

In the accompanying drawings

DESCRIPTION OF PREFERRED EMBODIMENTS

Figure 1A:
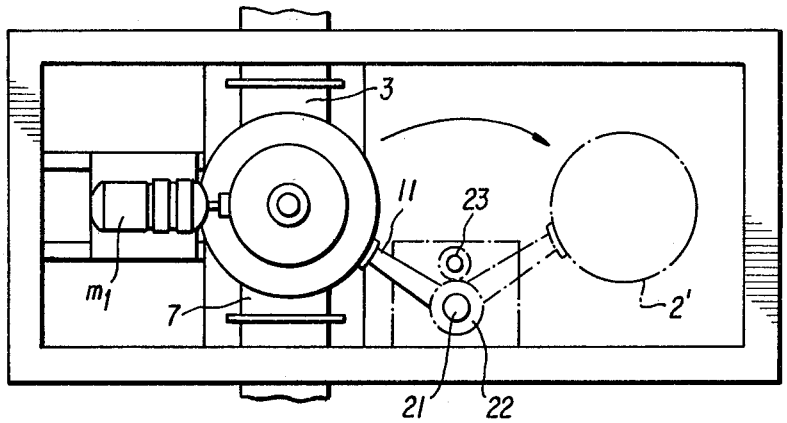
FIG. 1A is a diagrammatic plan view of a microwave melter according to the present invention.
Figure 1B:
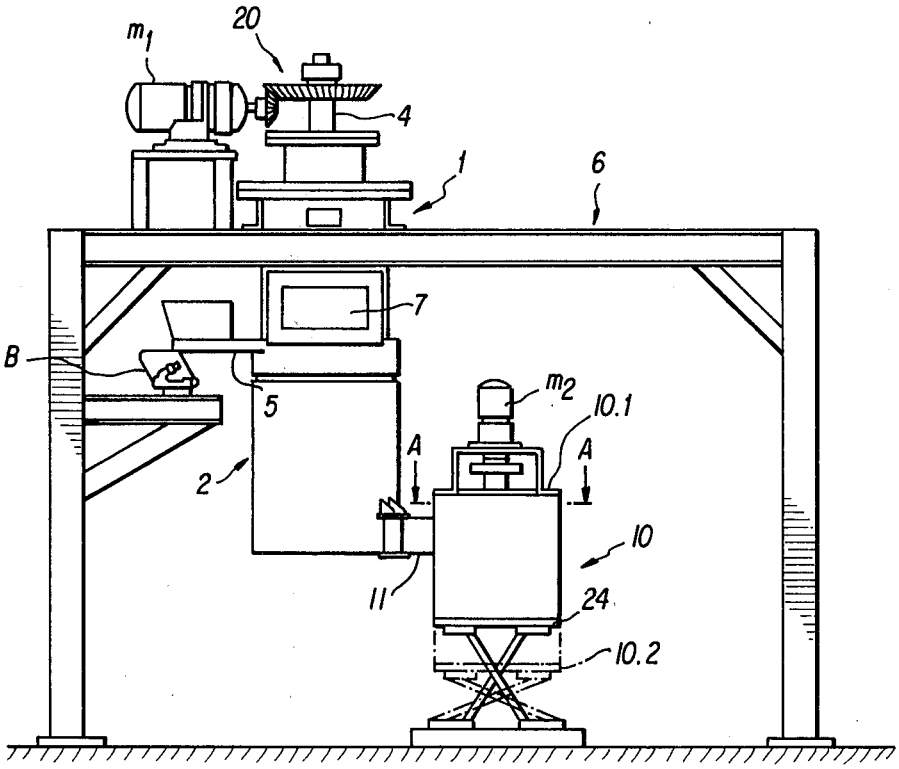
FIG. 1B is a diagrammatic side view of the same melter.

Referring to FIGS. 1A and 1B, the microwave melter of the present invention includes a melting furnace having an upper furnace body 1 and a lower furnace body 2. Located around the outer periphery of the furnace is a cooling mechanism which is normally in the form of piping for circulating a cooling medium (not shown). The upper furnace body 1 is provided with a microwave guide 3, a tuner 4 and a material feed pipe 5 supported fixedly on a support structure 6 independently of the lower furnace body 2. Indicated at $m_1$ is a motor for driving the tuner 4, the motor $m_1$ being coupled with the latter through a bevel gear mechanism 20 to allow adjustment of the height of tuner 4 within the furnace. The upper furnace body 1 is further provided with an exhaust pipe 7 for discharging from the furnace the suspended matter such as dust and fumes which are generated within the furnace to lower the efficiency of irradiation of the microwaves. On the other hand, the lower furnace body 2 accommodates therein a crucible 8 (FIG. 2) and is supported on a holder 10 movable toward and away from the upper furance body 1.

The holder 10 consists of a rotating mechanism 10.1 with a motor $m_2$ and a lift mechanism 10.2. The rotating mechanism 10.1 has a support arm 11 one end of which is connected to the lower furnace body 2. The support arm 11 is provided at the other end thereof with a gear 22 which is fixedly mounted on a shaft 21 as shown in FIG. 1A (in which the holder 10 is shown in a section taken on line A—A). The gear 22 is meshed with a gear 23 of the motor $m_2$ and driven therefrom to rotate the support arm 11 in a horizontal plane about the shaft 21, moving the lower furnace body 2 away from the upper furnace portion 1 into a retracted position indicated at 2'. On the other hand, the rotating mechanism 10.1 is supported on a lift table 24 of the lifting mechanism 10.2, which is moved up and down by a hydraulic or other drive force mechanism to move the lower furnace body 2 vertically toward and away from the upper furnace body 1.

In operation of the above-described melter, the lower furnace body 2 which holds the crucible 8 is connected to the upper furnace body by the turning and lifting operations of the holder 10 prior to charging the furnace with a material M which is fed from a feeder B through the feed pipe 5. In the melting operation, the suspended matter such as dust and fumes which are present in the furnace during the melting operation and which impede the irradiation of microwaves, is discharged through the exhaust pipe 7 while irradiating the material M within the crucible 8 with microwaves which are generated by a microwave generator (not shown) and led to the furnace through a waveguide 3. It is to be understood that the upper and lower furnace bodies 1 and 2 are tightly connected with each other in order to prevent leakage of microwaves which are led into the furnace or leakage of dust which is generated within the furnace during the melting operation.

In addition, it is necessary for the charged material to be uniformly irradiated with the microwaves in order to ensure efficient and smooth heating and melting operations. However, in actual operations, uniform irradiation by microwaves often becomes difficult when the feed material is charged into the furnace by a method or under conditions in which the material is apt to be charged in a greater amount in certain localities of the furnace or where the charged material has uneven surfaces which cause irregularities in the incident microwave efficiency, resulting in variations in the degree of heating between different portions of the charged material. This can be avoided by providing a plural number of microwave irradiating sources on the furnace, which, however, invites another problem in that the melter becomes large-sized and complicated in construction. These problems are solved in the present invention by providing a rotatable furnace construction.

Figure 2:
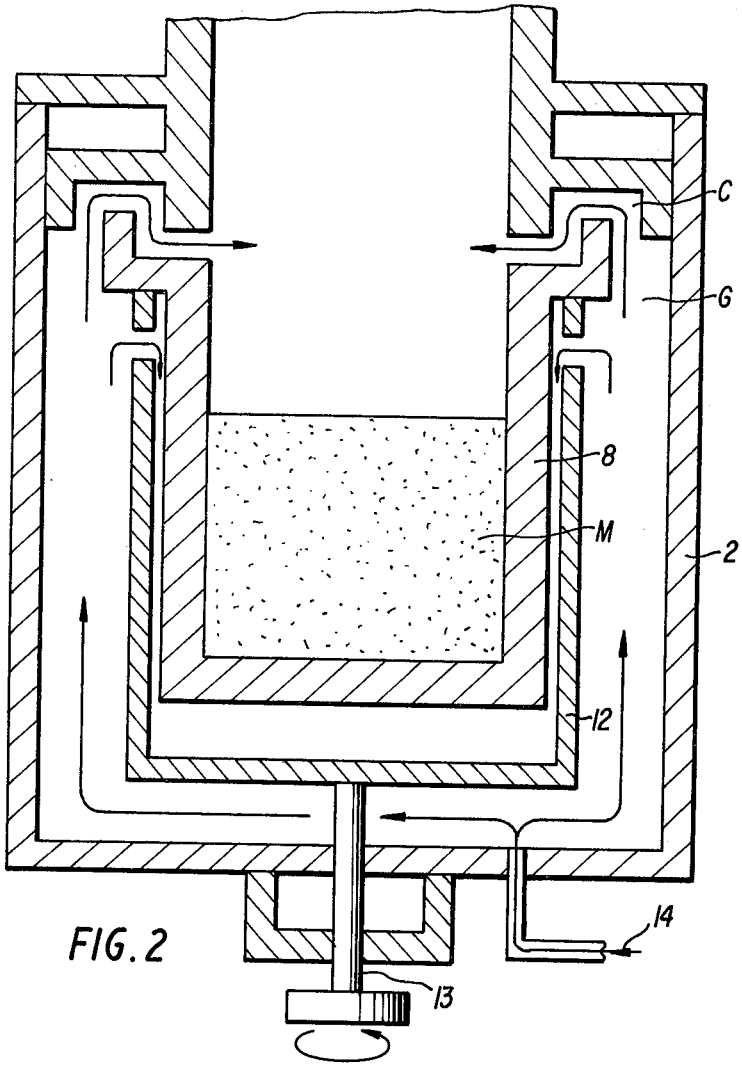
FIG. 2 is a diagrammatic vertical section showing a crucible which is received in the lower portion of the melter.

Referring to FIG. 2, the crucible 8 is suspended on a rotary body 12 which is mounted on a rotational shaft 13 in the bottom portion of the lower furnace body 2 for rotation in a horizontal plane. The shaft 13 is connected to a suitable rotational drive source (not shown), for example, to a drive motor which is mounted on the lower furnace body 2. The crucible 8 which is suspended on the rotary body 12 is thus rotated at a suitable speed during application of microwaves so that every part of the charged material M is uniformly irradiated by microwaves, that is to say, evenly heated and melted irrespective of the non-uniform distribution of the material M within the furnace or its uneven surface conditions.

The rotary body 12 is preferred to be detachably mounted on the lower furnace portion 2 to facilitate maintenance of the furnace in such a case where the molten material flows into the rotary body 12 due to a leak in the crucible 8. The crucible 8 is thermally expanded in the longitudinal direction during the melting treatment of the charged material. In the present invention, there occurs no problem in connection with the thermal expansion of the crucible since it is suspended on the rotary body 12.

When heating and melting the charged material, there sometimes arises a necessity for preventing reactions between the charged material and the atmosphere within the furnace for the purpose of obtaining a solidified material of certain chemical and physical properties after the melting treatment. In such a case, the furnace may be provided with a mechanism for introducing an inert gas to thereby create an inert atmosphere within the furnace. The introduction of an inert gas has an additional effect of lessening oxidative wear of the crucible itself, coupled with the cooling effect which prevents damage of the crucible due to overheating.

In the embodiment of FIG. 2, an inert gas inlet 14 is provided at the bottom of the lower furnace body 2 to feed an inert gas to the gap G between the outer periphery of the rotary body 12 and the inner periphery of the lower furnace body 2. The pressure of the inert gas atmosphere in the gap G is adjusted to a level slightly higher than the pressure of the atmosphere within the melting furnace so that the inert gas in the gap G flows into the furnace to form an inert gas atmosphere therein while preventing leaking of fumes or other exhaust gases through the gap C.

Figure 3:
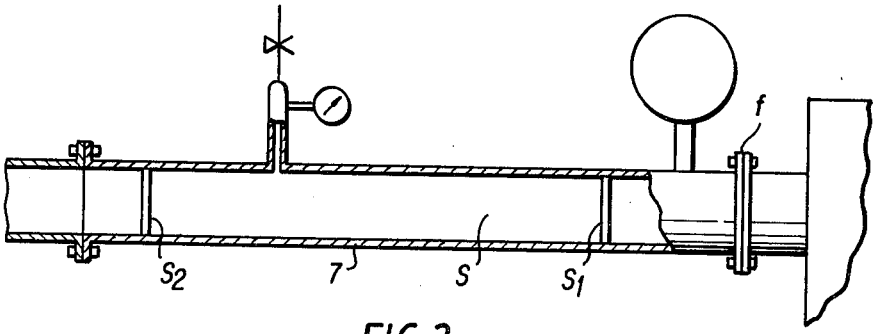
FIG. 3 is a diagrammatic sectional view of a waveguide employed in the present invention.

Fume gases which enter the waveguide 7 are irradiated by microwave and tend to lower the microwave energy efficiency to a considerable degree by causing discharging or other phenomena. In order to prevent this, it is preferred to provide a spacer within the waveguide 7 for supplying air or an inert gas to the space on the side of the furnace to form a gas flow which constantly purges the fume gas and dust toward the furnace. Particularly in the case of a melter which treats radioactive material, it is preferred to provide spacers $S_1$ and $S_2$ of Teflon polymer or quartz glass in the inner and outer end portions of the waveguide 7 as shown in FIG. 3. In a case where the air-tightness is impaired by fatigue of the inner spacer $S_1$, the space between the two spacers $S_1$ and $S_2$ is preferably filled with an inert gas which is pressurized to a level slightly higher than the pressure of the furnace atmosphere to thereby prevent gas flows from the furnace into the waveguide 7.

Figure 4A:
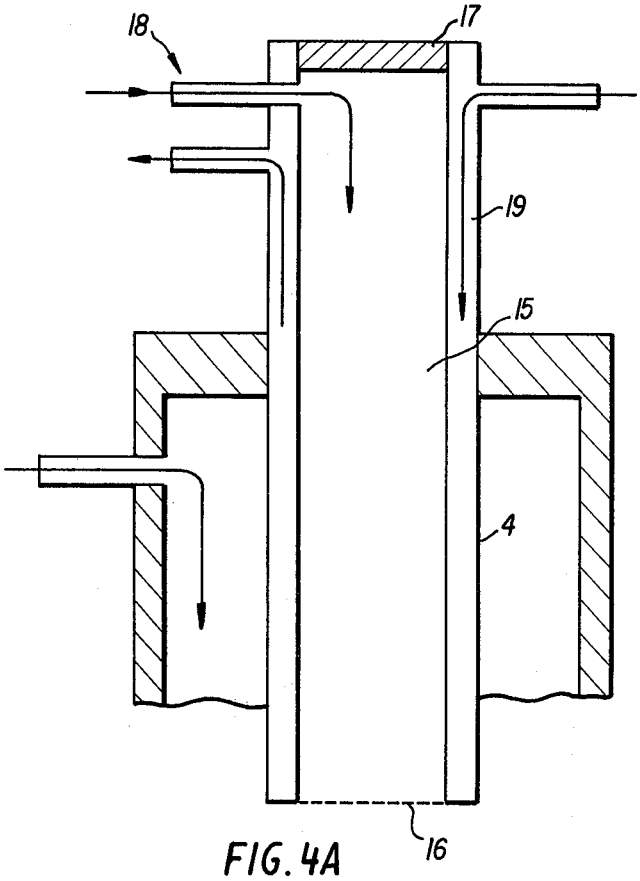
FIG. 4A is a diagrammatic sectional view of a tuner employed in the present invention.
Figure 4B:
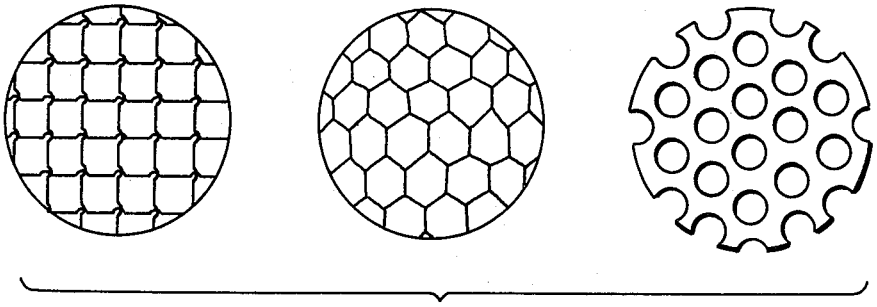
FIG. 4B is a diagrammatic view of embodiments of a net employed in the present invention.

The tuner 4 which is employed in the present invention has a construction as shown in FIG. 4A, including of a hollow metal body with a longitudinal bore 15. The tuner is provided with a net 16 of conductive material at the lower end thereof for blocking leakage of microwaves and with a window 17 of a plate-like light transmissive material like quartz glass at the upper end thereof to allow inspection therethrough of the inside of the furnace while blocking leakage of gases and dust which are produced within the furnace. The examples of the net 16 are shown in FIG. 4 (II).

Ingression of dust into the bore 15 of the tuner 4 can also be prevented by feeding thereto an inert gas from an inert gas inlet 18, which is pressurized to a level slightly higher than the internal pressure of the furnace. The tuner may be protected against the radiant heat by circulating cooling water around the exterior 19 thereof.

The crucible may be of a metallic material such as stainless steel or of a carbonaceous material such as graphite but it is preferred to use a metallic crucible. In a case where the charging material has a high melting point, there may be employed a crucible which has its inner surfaces coated with a layer of a heat insulating material of a high melting point such as of alumina cement.

In the melting operation by the melter of the present invention, the material to be treated may be continuously fed to the crucible to undergo the heating and melting treatment by the irradiated microwave in a continuous manner. Alternatively, after melting a batch of the material into a reduced volume, untreated material may be added to the melt again and again until the content of the crucible grows into a predetermined amount.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A microwave melter of the type in which material charged in a crucible of a furnace is heated and melted by irradiation of microwaves from a microwave oscillator, said melter comprising:

a waveguide connected to said microwave oscillator for guiding microwaves toward the furnace;

an upper furnace body connected to said waveguide;

a lower furnace body detachably connected to said upper furnace body;

a rotatable container provided in said lower furnace body and adapted to rotate said crucible in a suspended state;

a feed pipe for feeding untreated material to said crucible; and a tuner mounted on top of said upper furnace body for tuning said microwaves.

2. A microwave melter of claim 1, said lower furnace body further comprising an inert gas feed pipe means to feed to a gap between the inner periphery of said lower furnace body and the outer periphery of said rotatable container an inert gas of a positive pressure relative to the internal pressure of said furnace.

3. A microwave melter of claim 1, said rotatable container further comprising a rotational shaft and a rotating mechanism disposed at the bottom portion thereof.

4. A microwave melter of claim 1, said waveguide further comprising a plurality of air-tight spacers at spaced positions along the length thereof for maintaining the space defined between said spacers at a positive pressure relative to the pressure of the furnace atmosphere.

5. A microwave melter of claim 1, said tuner further comprising a longitudinal bore extending along the entire length thereof from an upper to a lower end thereof, a net of conductive material located at the inner end of said longitudinal bore, a glass window member provided at the outer end of said longitudinal bore, inner gas feed pipe means for introducing an inert gas into said longitudinal bore, and cooling means for cooling a body portion of said tuner.

6. A microwave melter of claim 1, said rotatable container being detachably mounted on said lower furnace body.

* * * * *

UNITED STATES PATENT AND TRADEMARK OFFICE

CERTIFICATE OF CORRECTION

PATENT NO. : 4,330,698

DATED : May 18, 1982

INVENTOR(S) : Sawada et al.

It is certified that error appears in the above-identified patent and that said Letters Patent are hereby corrected as shown below:

Column 1, line 42, delete the colon after "including"; line 43, insert a comma after "structure"; line 45, insert a comma after "body"; line 46, insert a comma after "body"; line 48, insert a comma after "waveguide".

Column 2, line 30, change "furance" to --furnace--; line 31, change "consists of" to --includes--; and line 57, delete "the".

Column 4, line 6, change "polymer" to --polymers--;and line 16, delete "of".

Signed and Sealed this

Eleventh Day of January 1983

[SEAL]

Attest:

GERALD J. MOSSINGHOFF

Attesting Officer

Commissioner of Patents and Trademarks